United States Patent [19]

Slaughter

[11] 4,054,790

[45] Oct. 18, 1977

[54] LIGHT FIXTURE

[75] Inventor: Robert A. Slaughter, Houston, Tex.

[73] Assignee: Esquire, Inc., New York, N.Y.

[21] Appl. No.: 687,039

[22] Filed: May 17, 1976

[51] Int. Cl.[2] ..... F21S 1/02; H01F 15/02

[52] U.S. Cl. ..... 362/264; 362/265; 362/373

[58] Field of Search ..... 240/11.2, 11.4, 25, 240/DIG. 3, 51.11, 52 HT; 174/DIG. 2; 248/8, 9, 15, 18

[56] References Cited

U.S. PATENT DOCUMENTS

| | | | |
|---|---|---|---|
| 3,049,579 | 8/1962 | Sulzer | 174/DIG. 2 |
| 3,555,267 | 1/1971 | Sutter | 240/51.11 |
| 4,000,406 | 12/1976 | Bhavsar | 240/25 |

*Primary Examiner*—L. T. Hix
*Assistant Examiner*—Alan Mathews
*Attorney, Agent, or Firm*—W. F. Hyer; Marvin B. Eickenroht

[57] ABSTRACT

There is disclosed a light fixture having a ballast mounted on the housing thereof by means of a metal bracket having side walls which are connected to one another to form a corner and a base wall connected to each of the side walls intermediate their opposite ends. The side walls of the bracket are secured to adjacent metal side walls of the housing which are connected to one another at a corner thereof, and the ballast is releasably connected to the base wall of the bracket.

14 Claims, 8 Drawing Figures

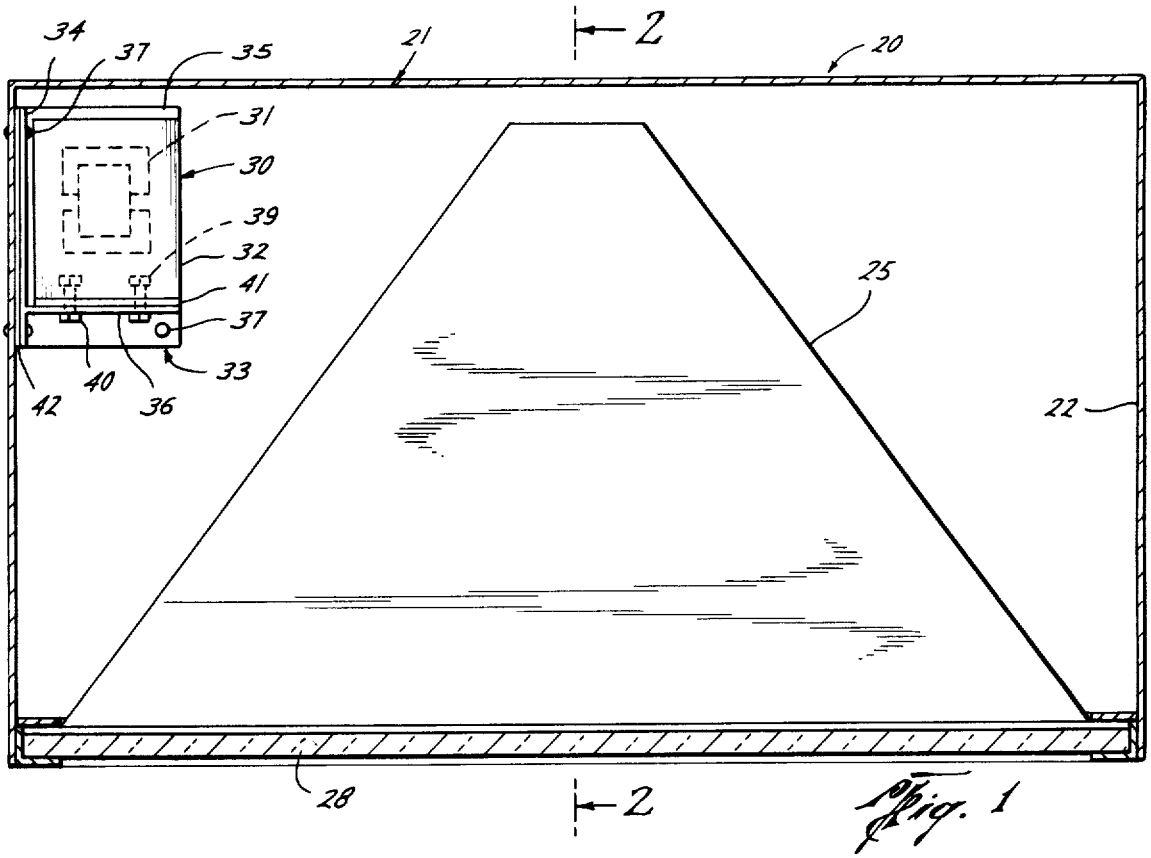
Fig. 1
Fig. 2
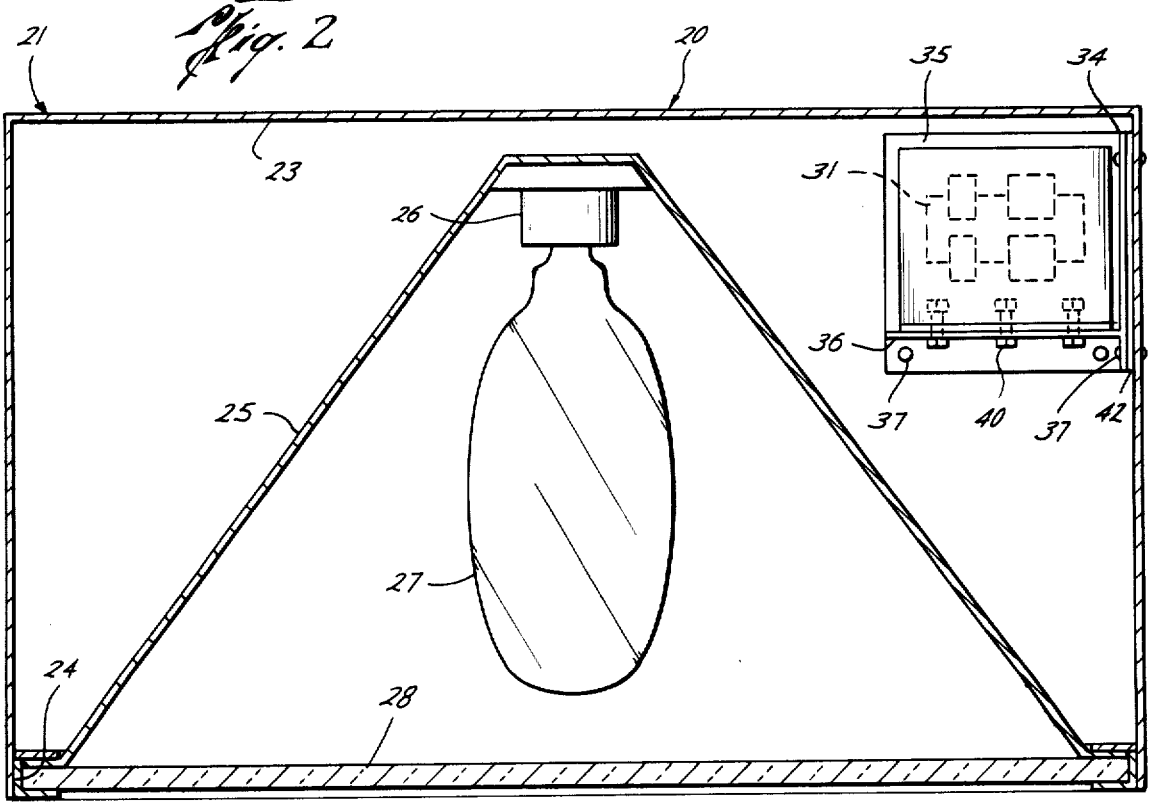

LIGHT FIXTURE

This invention relates to light fixtures of the type which use gaseous discharge lamps requiring ballasts. More particularly, it relates to fixtures of this type in which the ballast is mounted on the housing of the fixture in a new and improved manner.

During operation of the fixture, the ballast generates a substantial amount of heat which, unless dissipated, may have adverse affects on the ballast as well as upon other components of the fixture. The ballast is also a source of considerable noise which may exceed the permissible levels. Prior efforts to mount the ballast in such a manner as to both remove heat from the ballast and reduce the noise have not been entirely satisfactory. Thus, because of seemingly counteracting considerations, previous attempts to isolate the noise by cushioning the mounting have made it difficult to remove heat from the ballast; and, conversely, previous attempts to conduct heat from the mounting to the fixture housing have made it difficult to reduce noise.

It is therefore the primary object of this invention to provide such a light fixture in which the ballast is so mounted as to both dissipate heat and reduce noise level to a greater degree than heretofore possible.

Another object is to provide such a fixture in which the ballast is mounted on the fixture housing by means including a bracket which is relatively inexpensive to build and easy to install.

These and other objects are accomplished, in accordance with the illustrated embodiment of the invention, by a fixture in which the ballast is mounted on the housing by means which includes a metal bracket having first and second walls connected to one another to form a corner, and a third wall connected to each of the second and third walls intermediate their opposite ends. The ballast is releasably connected to the third wall of the bracket with its adjacent walls spaced a short distance from the first and second walls of the bracket, and the latter walls of the bracket are secured to adjacent metal walls of the housing which are connected to one another at a corner thereof. Resilient material is compressed tight between the ballast and the third wall of the bracket, and a layer of acoustically insulating, heat conductive material compressed tightly between the housing and bracket side walls.

The resilient material compressed between the base wall of the bracket and the ballast serves to dampen or snub vibrations in the ballast which would otherwise be transmitted to the metal bracket. Also, the layer of acoustical material compressed between the bracket and housing walls not only dampens airborne noise from the walls of the ballast opposite the first and second bracket walls, but also dampens noise which is transmitted from the third wall of the bracket to the first and second walls thereof. Since the third wall has a "T" shaped connection with each of the first and second walls of the bracket noise transmitted to the third wall of the bracket must turn a corner and thus be attenuated according to laws of sound.

Since the bracket is metallic, and preferably alluminum, it provides a heat sink for the ballast, and since the layers compressed between the bracket and housing walls are heat conductive, the housing in turn acts as a heat sink for the bracket. The spaces between the ballast and the first and second walls are relatively small, so that it permits relatively good radiation of heat from the ballast to the bracket walls, despite the lack of intimate contact.

The core and coil device may be molded into a body of potting compound, in which case the resilient material is compressed between the third wall of the bracket and an adjacent wall of the body. When not so contained, however, the core and coil device is mounted on the bracket with the windings of its coil received in an opening in the third wall and the ends of its core connected to such wall at opposite ends of the opening.

In the drawings, wherein like reference characters are used throughout to designate like parts:

FIG. 1 is a vertical sectional view of a light fixture having a ballast mounted on the housing thereof by means of a bracket constructed in accordance with one embodiment of the present invention;

FIG. 2 is another vertical sectional view of the light fixture of FIG. 1, as seen along broken lines 2—2 of FIG. 1;

Figure 3:
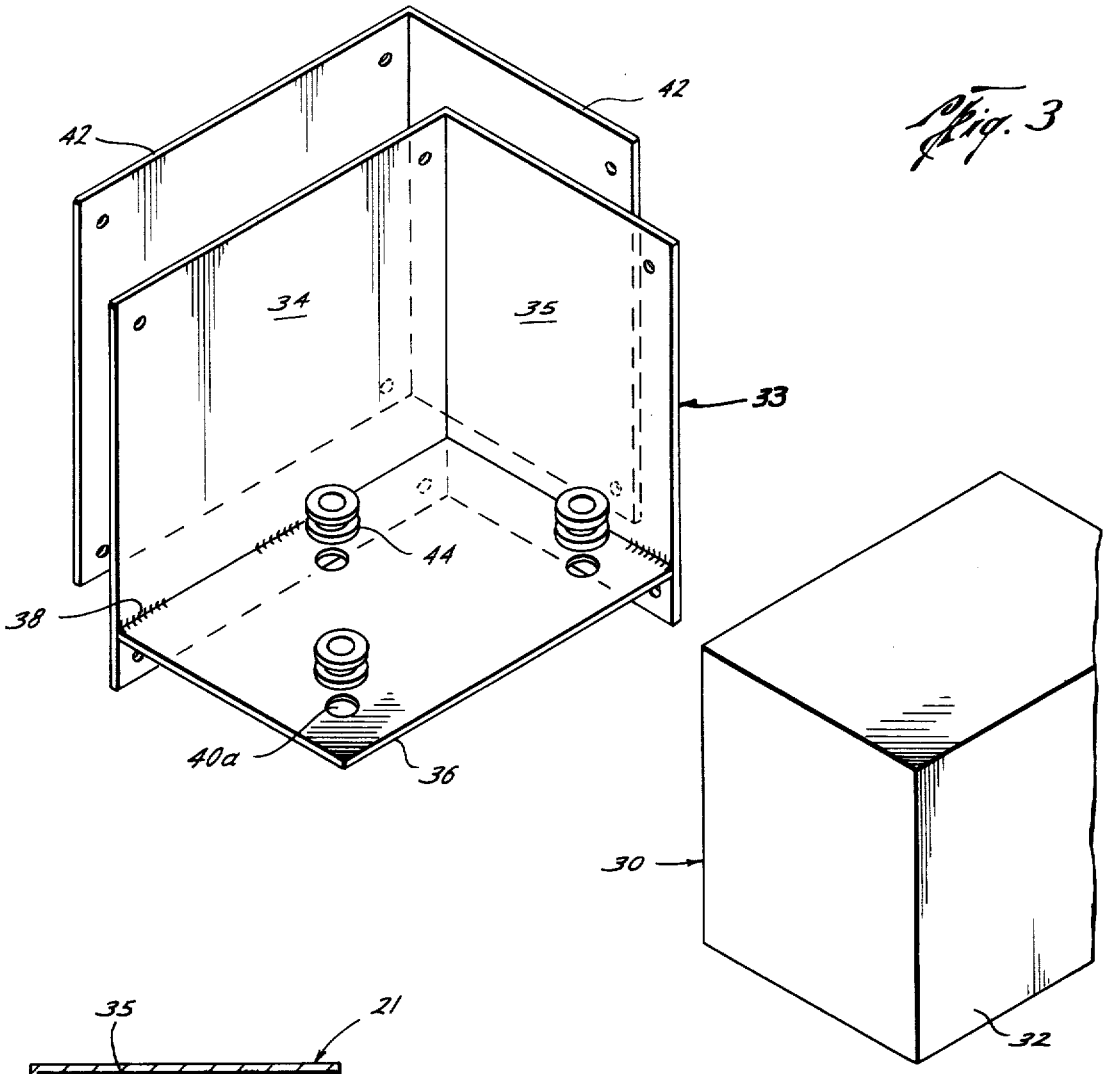
FIG. 3 is an exploded perspective view of the ballast, bracket, and layers of acoustically insulating and heat conductive material to be compressed between the bracket and the side walls of the housing, as shown in FIGS. 1 and 2, but with the resilient material to be compressed tightly between the ballast and base wall of the bracket shown in a modified form.

With reference now to the details of the above-described drawings, the fixture shown in FIGS. 1 and 2 and indicated in its entirety by reference character 20, includes a box-like housing 21 having side walls 22 and a top wall 23 at its upper end, which are fabricated from aluminum or other heat conductive metal, and a window 24 in its lower end. The window is closed by a pane 28 of transparent or translucent material, and a metal reflector 25 of pyramid shape is mounted within the housing opposite the window 24. A lamp 27 of gaseous discharge type is carried within a socket 26 in the upper end of the reflector, so that light from the lamp 27 is reflected by the inner surface of the reflector through the window. As will be appreciated, the above-described light fixture is merely typical and for illustrative purposes only.

A ballast 30 for the lamp is mounted on the housing within the enclosed portion thereof on the outer side of the reflector. Consequently, there is considerable need for dissipating the heat which the ballast generates. As indicated in broken lines, the ballast includes a core and coil device 31 which is molded within a block-like body 32 of potting compound and mounted on the housing by means of a bracket 33. As also shown in FIG. 3, the bracket includes side walls 34 and 35 connected to one another to form a corner, and a base wall 36 connected to each of the side walls intermediate the upper and lower ends of the side walls.

Side walls 34 and 35 of the bracket are connected by rivets 37 to adjacent side walls 22 at one corner of the fixture housing 21. Normally, both the side walls of the bracket and the adjacent side walls of the housing extend at right angles to one another, although this invention contemplates that the corners could instead describe angles of more or less than 90°. In any event, however, the angle formed between the side walls of the bracket is substantially equal to the angle formed between the side walls of the housing so that the corner of the bracket fits snugly within the corner of the housing. As shown in FIGS. 1 and 2, the upper ends of the side walls 34 and 35 are spaced from the top wall 23 of the housing.

In the illustrated embodiment of the invention, base wall 36 extends at right angles with respect to the side walls 34 and 35, so as to form a "T" at its intersection therewith, although the invention contemplates that this angle also may be more or less than 90°. In any event, it is important, for reasons to be described to follow, that the base wall intersect with the side walls intermediate their upper and lower ends, whereby each of the side walls has a lower portion which depends from the base wall 36. Also, although the bracket is shown to be secured to the housing by means of six rivets, four of which are formed near the corners of side wall 34, and the other two of which are formed in the corners of the side wall 35 remote from its intersection with side wall 34, other means may be provided for this purpose. Still further, although in the illustrated fixture, the side walls are vertical and the wall 36 is substantially horizontal, this is merely a preferred arrangement.

As shown, the upper edges of the side walls 34 and 35 extend upwardly to a height just above the top surface of ballast 30, and the lower ends of side walls 34 and 35 extend below base wall 36 only to the extent required to receive rivets 37. Also, the inner sides of the body of the ballast are spaced only a short distance from the adjacent inner surface of the side walls 34 and 35, and the other side surfaces of the ballast are substantially flush with the outer edges of the side walls 34 and 35. Thus, in the interest of economy, the outer dimensions of the bracket are substantially no larger than those of the ballast. Toward this same end, the bracket walls need be no thicker than necessary to provide structural support for the ballast.

As best shown in FIG. 3, the side walls of the bracket are formed from a single bent sheet, and the base wall is connected to the side walls by means of weldments 38. In this particular embodiment of the invention, wherein the core and coil device is molded within a body of potting compound, outer edges of wall 36 are parallel to the side walls of the bracket, thus providing a full support for the bottom side of the ballast.

A potted ballast of this type normally has holes formed in its bottom side to receive screws for connecting it to a supporting surface. More particularly, inserts 39 having internal threads are normally molded into the potting compound at the innermost ends of the holes. The ballast is thus connected to base wall 36 by means of screws 40 which extend through holes **40*a* in the base wall 36 for threaded connection with inserts 39.**

As previously described, a resilient material is compressed tightly between the top surface of the base wall and the bottom side of the ballast so as to dampen much of the vibration in the ballast which would otherwise be transmitted to the metal bracket wall. In the embodiment of the invention shown in FIGS. 1 and 2, the resilient material comprises a pad 41 which is substantially coextensive with the bottom surface of the ballast so as to provide full support therefor. The screws 40, of course, compress the resilient pad, as they are made up with the threaded holes in the ballast to draw the ballast 30 into secured position. Since the primary purpose to be served by the pad 41 is to cushion the ballast, it may be of a conventional cushioning material, such as silicone rubber which is capable of withstanding the temperatures encountered in this environment. Preferably, however, the pad will be formed of a material which is also heat conductive so as to be more efficient in conducting heat from the ballast to the base wall 36 of the bracket, and a preferred material for this latter purpose will be described in a subsequent portion of this description.

A layer 42 of acoustically insulating, heat conductive material is compressed tightly between the adjacent side walls of the housing and bracket as they are riveted to one another. As in the case of the cushioning pads 41, each of the layers 42 should be of a material capable of withstanding the environmental temperature, which in the case of a light fixture of the type described is about 190° F. under continuous use. Although a Teflon or polymer speckled with brass particles may be found suitable, I have found a polymer solid by the Soundcoat Company, Inc., of New York, under the trademark "DYAD" to possess characteristics which are particularly desirable for this purpose. Although this material has heretofore been recommended for use in damping vibrations in metal plates, I have found that it has extremely good noise attenuating characteristics when it is sandwiched tightly between the side walls of the bracket and housing, as by rivets, as shown, or other suitable means.

In any event, as used in the present invention, "DYAD" polymer is especially well suited to not only reducing noise due to vibrations transmitted to the bracket, but also is reducing or attenuating airborne noise across the air space between the side walls of the ballast and the inner surfaces of the side walls of the bracket. Furthermore, this material is known to have exceedingly good heat conductive characteristics so as to conduct the heat from the metal bracket to the metal side walls of the housing. For these reasons, if cost considerations permit, pad 41 might also be made of this same material.

It is also preferred that the layers be formed in a single sheet which is flexible so as to permit it to be bent about the corner of the bracket formed by the side walls 34 and 35. The "DYAD" polymer not only possesses such flexibility, but also has good shear strength and is sufficiently resilient to permit it to conform to voids in the walls of the housing and bracket so as to minimize the possibility of air gaps which would otherwise interfere with good heat conduction.

As previously noted, the "T" connections of the base wall of the bracket to the side walls provide sharp corners which attenuate sound waves transmitted to the side walls. Reference in this respect may be had to the discussion of the law of discontinuity of structure in *Noise Reduction* by Leo L. Beranek. It will also be apparent that this expression is used in a broad sense since, from an acoustical standpoint, it is not necessary that the walls intersect at right angles.

As shown in FIG. 3, the resilient material compressed between the ballast 30 and base wall 36 of the bracket may be in the form of grommets 44 of rubber or other suitable material capable of withstanding the temperatures to be encountered. As will be understood, the grommets are aligned with holes 40*a* in the base wall so that the screws may pass therethrough in being threadedly connected to the ballast 40. Obviously, as the screws are made up, they draw the bottom of the ballast securely down into position on the compressed grommets, while holding the remainder of the bottom of the ballast spaced above the remainder of the top surface of the walls 36.

Figure 4:
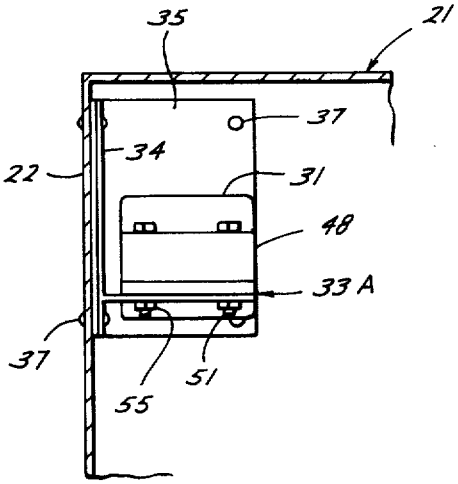
FIG. 4 is a partial vertical sectional view of a fixture having a housing similar to that of the fixture of FIGS. 1 and 2, but with an unpotted ballast mounted thereon by means of a bracket constructed in accordance with another embodiment of the invention.
Figure 5:
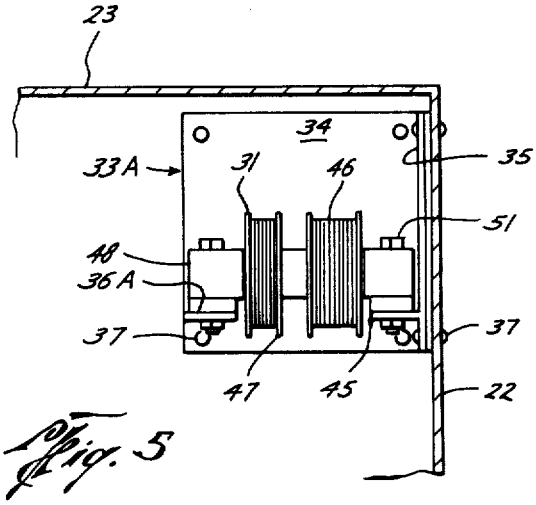
FIG. 5 is a vertical sectional partial view of the fixture of FIG. 4, as seen at right angles thereto.
Figure 6:
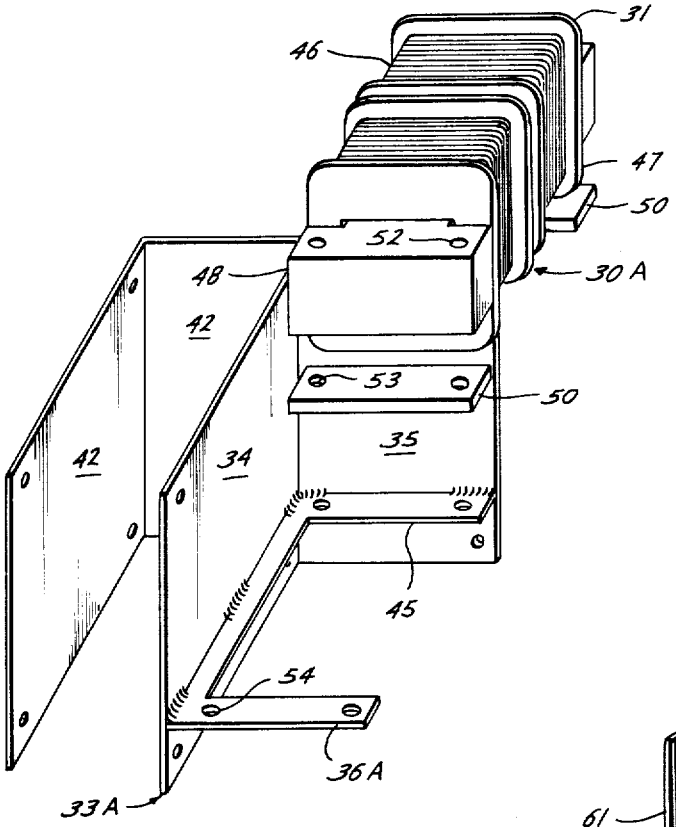
FIG. 6 is a perspective, exploded view of the ballast, bracket and layers of acoustically insulating and heat conductive material of the fixture of FIGS. 4 and 5.

The bracket 33A shown in FIGS. 4, 5 and 6 differs from bracket 33 in a manner which makes it especially well suited to support a ballast 30A which is not molded into a body of potting compound. Thus, as shown, the base wall 36A has an opening 45 formed therein to receive the coil windings 46 and bobbins 47 of the core and coil device when the opposite ends of the core 48 thereof are supported upon shelves formed on wall 36A at the opposite ends of opening 45. Pads 50 of suitable resilient material, such as that previously described, are disposed between the ends of the core and the shelves so as to be compressed tightly therebetween as the ballast 33A is releasably connected to base wall 36A, by means of bolts 51. Thus, as shown, holes 52 are formed in the end of the core, holes 53 are formed in the pad 50, and holes 54 are formed in the shelves of base wall 36A, all for alignment with one another to receive bolts 51 over which nuts are threaded so as to draw the ballast toward the base wall. With ballast 30A so supported, its side facing side walls 34 and 35 are spaced therefrom a short distance.

In other respects, bracket 33A is identical to bracket 33 in that its side walls 34 and 35 are connected to one another to form a corner. Also, of course, base wall 36A is connected to the side walls intermediate their upper and lower ends, and extends perpendicularly thereto so as to support ballast 30A in a horizontal position. Furthermore, the side walls are adapted to be riveted to adjacent side walls of the housing, with layers 42 of acoustically insulating, heat conductive material tightly compressed therebetween. Still further, the layers may be identical to those previously described.

Figure 7:
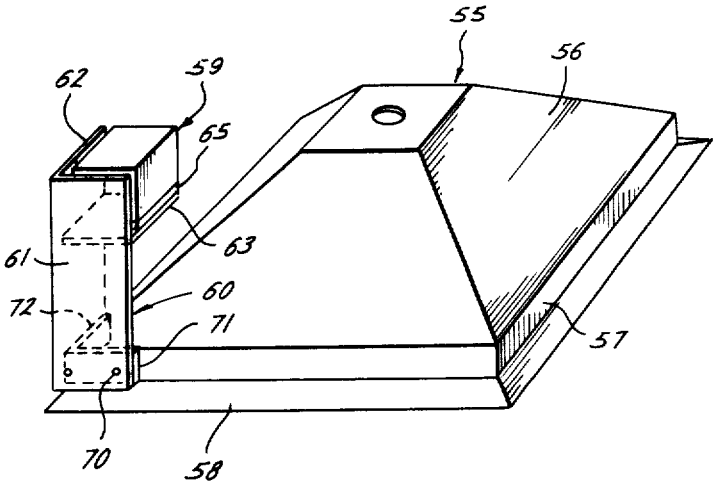
FIG. 7 is a perspective view as seen from the top and one side of a light fixture having a ballast mounting on the housing by means of a bracket constructed in accordance with still another embodiment of the invention.

The light fixture shown in FIG. 7 and indicated in its entirety by reference character 55 differs from fixture 20 in that its reflector 56 within which a lamp (not shown) is carried is disposed across the upper ends of side walls 57 to form the upper end of the fixture housing. Flanges 58 extending from the lower ends of the side walls provide a means by which the fixture may be mounted within a ceiling.

Figure 8:
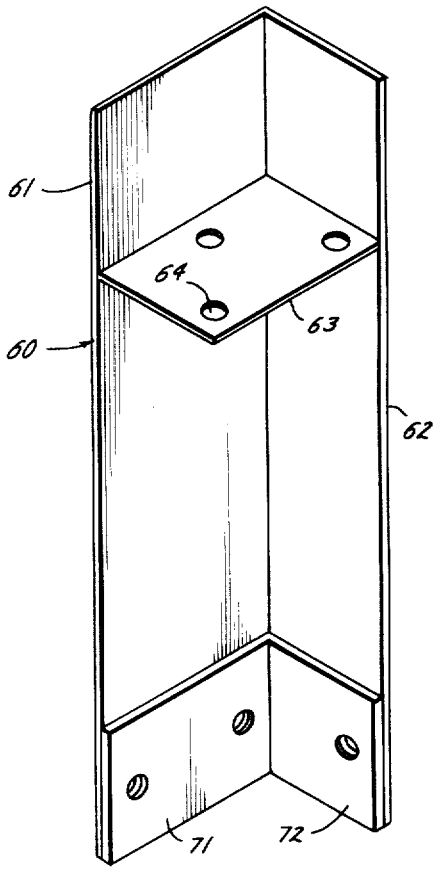
FIG. 8 is a perspective view of the bracket and layers of acoustically insulating and heat conductive material of FIG. 7, as seen from the inner corner thereof.

Ballast 59, which may be identical to the ballast 30, is mounted on the outer side of the housing by means of a bracket 60 connected to side walls 57 at one corner of the housing. As best shown in FIG. 8, bracket 60 includes side walls 61 and 62 which are connected to one another to form a corner, and a base wall 63 which is connected to each of the side walls intermediate the upper and lower ends of the side walls. Although the housing and bracket side walls are shown to intersect one another, and the bracket base wall is shown to intersect its side walls, at right angles, it will be understood from the foregoing description of the brackets shown in FIGS. 1 to 6 that the angles may be more or less than 90°.

As in the case of the previously described embodiments of the invention, the ballast 59 is releasably connected to the top surface of base wall 63 with the sides thereof which face the side walls 61 and 62 of the bracket being spaced a short distance therefrom, as shown in FIG. 7. The ballast is so connected by means of screws (not shown) adapted to pass through holes 64 preformed in base wall 63 for threaded connection with the ballast, as previously described in connection with ballast 30 and bracket 33. As also shown in FIGS. 1 and 2, resilient material in the form of a pad 65 is disposed between the bottom wall of the ballast and top surface of the base wall of the bracket so as to be compressed tightly therebetween.

As compared with the previously described brackets, however, bracket 60 is mounted on housing 55 by means of the portions of side walls 61 and 62 which depend from base wall 63. Thus, the inner surfaces of these downwardly extending portions are secured to the outer surfaces of the side walls 57 of the housing by means of rivets 70, and layers 71 and 72 of acoustically insulating, heat conducting material of the type previously described are disposed between the side walls of the bracket and housing so as to be tightly compressed therebetween as the bracket is secured to the side walls of the housing. As in the previously described embodiment, these layers are preferably formed from a single flexible sheet.

As will be appreciated, the side walls 61 and 62 may be of any desired height so as to remove the ballast a desired distance from the reflector 56, having in mind whatever height limitations might be imposed on the fixture by the environment in which it's installed.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the present invention without departing from the scope thereof, it is to be understood that all matter herein set forth or shown in the accompanying drawings is to be interpreted as illustrative and not in a limiting sense.

The invention having been described, what is claimed is:

1. A light fixture, comprising a housing having first and second metal walls connected to one another at a corner thereof, a metal bracket having first and second walls connected to one another to form a corner, and a third wall connected to each of the first and second walls intermediate their opposite ends, a ballast including a core and coil device, means for releasably connecting the ballast to the third wall of the bracket, resilient material compressed tightly between the third wall and the ballast, means for securing each of the first and second walls of the bracket to the first and second walls of the housing, and a layer of acoustically insulating, heat conductive material compressed tightly between adjacent walls of the housing and bracket, the walls of the ballast being spaced a short distance from the inner faces of the first and second walls of the bracket.

2. A light fixture of the character defined in claim 1, wherein the ballast includes a body of potting compound into which the core and coil device is molded.

3. A light fixture of the character defined in claim 1, wherein said layers comprise a single, flexible sheet of said material which is bent at the corner of the bracket.

4. A light fixture of the character defined in claim 1, wherein said layers are disposed over the outer faces of the first and second bracket walls.

5. A light fixture of the character defined in claim 1, wherein said layers are disposed over the inner faces of the first and second bracket walls.

6. A light fixture of the character defined in claim 1, wherein the third wall of the bracket has an opening into which windings of the coil extend, and the resilient material comprises a layer disposed between the core at each end of the device and the third wall of the bracket at opposite ends of the opening.

7. A light fixture of the character defined in claim 1, wherein the ballast includes a body of potting compound into which the core and coil device is molded, and said resilient material comprises a layer disposed between the third wall of the bracket and the adjacent wall of said body.

8. A light fixture of the character defined in claim 1, wherein the ballast includes a body of potting compound into which the core and coil device is molded, the connecting means comprise screws extending through the third wall of the ballast and into threaded connection with the body, and said resilient material comprises grommets surrounding said screws.

9. A light fixture, comprising a housing having upper and lower ends, metal side walls connected to one another at its corners, a window, means for mounting a lamp within the housing, a reflector across the window for reflecting light therethrough, a metal bracket having a pair of side walls connected to one another at one corner, and a generally horizontal base wall connected to each of the side walls intermediate the upper and lower ends thereof, a ballast including a core and coil device, means for releasably connecting the ballast to the top surface of the base wall of the bracket, resilient material compressed tightly between the bottom of the ballast and the top surface of the bracket base wall, means for securing each side wall of the bracket to an adjacent side wall at the corner of the housing on the outer side of the reflector, and a layer of acoustically insulating, heat conductive material compressed tightly adjacent side walls of the housing and bracket, the walls of the ballast being spaced a short distance from the inner faces of the side walls of the bracket.

10. A light fixture of the character defined in claim 9, wherein the portion of the housing on the outer side of the reflector is enclosed, and the side walls of the bracket are secured to the inner surfaces of the side walls of the housing within the enclosed portion thereof.

11. A light fixture of the character defined in claim 9, wherein the portion of the housing on the outer side of the reflector is open, and the side walls of the bracket are secured to the outer surfaces of the side walls of the housing.

12. A light fixture of the character defined in claim 9, wherein the ballast includes a body of potting compound into which the core and coil device is molded.

13. A light fixture of the character defined in claim 9, wherein said layers comprise a single, flexible sheet which is bent at the corner of the bracket.

14. A light fixture of the character defined in claim 9, wherein the base wall of the bracket has an opening into which the windings of the coil extend.

* * * * *